US006000574A

United States Patent [19]

Portillo

[11] Patent Number: 6,000,574

[45] Date of Patent: Dec. 14, 1999

[54] PAINTING UTENSIL MOUNT FOR ATTACHMENT TO PAINT CONTAINERS

[76] Inventor: Christopher Portillo, 1110 Madden Ave., San Diego, Calif. 92154

[21] Appl. No.: 09/000,813

[22] Filed: Dec. 30, 1997

[51] Int. Cl.[6] ..... B44D 3/06

[52] U.S. Cl. ..... 220/736

[58] Field of Search ..... 220/601, 735, 220/736

[56] References Cited

U.S. PATENT DOCUMENTS

| | | | |
|---|---|---|---|
| 1,254,714 | 1/1918 | McCombs | 220/736 X |
| 1,682,571 | 8/1928 | Horan | 220/735 X |
| 1,687,179 | 10/1928 | Peterson | 220/736 X |
| 2,175,735 | 10/1939 | Banks | 220/735 X |
| 2,654,504 | 10/1953 | Hyams | 220/736 |
| 3,085,583 | 4/1963 | Seik | 220/736 X |
| 3,406,812 | 10/1968 | Henry | 220/735 X |
| 4,982,471 | 1/1991 | Bannan | 220/736 X |
| 5,549,209 | 8/1996 | Weissman et al. | 220/736 X |
| 5,799,813 | 9/1998 | Letica | 220/601 X |

*Primary Examiner*—Steven Pollard
*Attorney, Agent, or Firm*—Donn K. Harms

[57] ABSTRACT

A device for mounting and sealed storage of paint utensils such as rollers and paint brushes inside conventionally used paint containers. The device features a containment cylinder having an end wall with an attached mount for the handle end of a painting utensil such as a brush or roller thereon and an open end configured to removably mount to the orifice communicating through the lid of a conventional paint container. The containment cylinder may be of fixed, telescopic, or a collapsible configuration and may be varied in dimension and mounting configuration to accommodate the mounting in a sealed environment of a variety of sized and configured painting utensils. The device allows for storage of painting utensils inside the sealed receptacle formed by the paint container and communicating containment cylinder when the lid is attached to the container. The containment of the utensils in the closed container eliminates escaping vapors from paint and varnish like liquids escaping into the atmosphere and keeps the utensil useable while preventing drying of the paint thereon. The painting utensils may be quickly mounted or dismounted for storage during short or long periods of non use eliminating unneeded cleaning of the utensil or the need to store it in a separate sealed container to prevent vapors from escaping into the atmosphere.

20 Claims, 5 Drawing Sheets

PAINTING UTENSIL MOUNT FOR ATTACHMENT TO PAINT CONTAINERS

BACKGROUND OF THE INVENTION

1. Field of the Invention

The present invention relates to a device for sealing containers for prevention of evaporation of volatile chemicals in the container. More particularly it relates to a device which mounts to a variety of conventional paint containers allowing the container to be used for storage of brushes and rollers inside the container during non-use, while concurrently sealing the container and preventing evaporation of volatile chemicals in the paint, varnish, or similar liquid, to the atmosphere.

2. Prior Art

As long as there have been structures, there has been paint covering, protecting, and decorating them. Be it in homes, business, industry, or the military, the eventuality of painting and repainting during building and maintenance of such structures must be faced by all.

Commercial painting in the last decade has come under increasing regulation by different federal and state agencies. In the ever vigilant quest to control air pollution, professional painters have been required increasingly to limit and/or cease allowing the evaporation into the atmosphere of volatile compounds in paint. The paint and the chemical reaction which allow paint to "dry" upon surfaces inherently allow for evaporation of liquefying agents contained in the pigment of the paint.

New government regulations are requiring that professional painters cover all containers completely when they are left unattended. Such regulations undoubtedly at some point will apply to homeowners and other such non professional painters.

This requirement of full containment of paint laden containers is intended to reduce the evaporation of volatile vapors in the paint in the container into the atmosphere when the pain container is left unattended. A vexing problem for professional painters under the ever more stringent regulations is what to do with the painting implements such as brushes and rollers during breaks for lunch, meetings, or until the next days work.

In prior years environmental concerns regarding evaporation were not an issue when storing paint utensils and paint during non use. When the container of paint was left for a short period, it was covered with a rag or other manner with the roller or brush on top of the container or submerged in the paint in the container with the top off to all for the extended handle. Volatile vapors from the paint were allowed to evaporate into the atmosphere. However, under new and more stringent government guidelines such as the Environmental Protection Agency rules regarding paint and volatile liquids, full containment is required of vapors from the paint to prevent evaporation of the vapors into the atmosphere.

Consequently, even if left for a short lunch or break, the professional painter is required to seal the container during his or her absence. Sealing a conventional 5 gallon or 1 gallon paint container leaves no room to accommodate the roller or paint brush of a length longer than the container is tall. As such, professional painters, in order to leave their position for lunch or even a short break, under new regulations, must make some accommodation for the brush or roller when the paint container is sealed such that the roller or brush does not dry out and need cleaning or worse replacement.

Cleaning brushes and rollers just to take a short break is not only time consuming, it wastes paint and may actually contribute more pollution to the environment in the form of wasted paint being washed from the paint brushes and rollers. Further, nightly cleaning of brushes and rollers also wastes paint and the valuable professional's time which could be better spent applying paint to needed areas rather than removing paint from brushes and rollers and other utensils.

Some prior art attempted to solve storage problems of painting utensils in the past when extreme vigilance was not required due to lax environmental standards.

U.S. Pat. No. 1,779,018 (Smallwood) teaches an elastic paint container cover for a paint brush. Smallwood requires the elastic cover to be larger than the can it is to seal. It would not be easily used upon large five and ten gallon conventionally used paint containers and would require replacement of the factory provided lid. As such containers are generally refilled and recycled, replacing the factory lid would inhibit this recycling through lost lids. Further the large diameter of five and ten gallon commercial containers would render the even larger elastic lid of Smallwood fragile and easily damaged or distended into the container.

U.S. Pat. No. 5,314,061 (Bedrossian) teaches a paint container with a rectangular mouth and lid for sealing a roller inside when not in use. Bedrossian requires the transfer of paint from the commercial containers commonly used and into the separate container for sealing thus requiring the extra step of emptying the conventional container therein. Bedrossian thus inhibits the commercial standard for painting which uses factory containers themselves as paint disbursement containers and requires doubling the number of containers in use.

U.S. Pat. No. 5,316,137 (Kyllonen) teaches a rectangular tray with cover as a separate container to be used for application of paint to surfaces. Kyllonen requires doubling the number of containers in use by requiring a separate container from the conventionally used factory container.

U.S. Pat. No. 4,125,210 (Embree) features a lid with a chamber for holding a brush therein. Embree however requires the use of a special adapter and cover which replace the factory provided recyclable cover in use conventionally. Further, Embree would require constant cleaning due to the sealing of the brush horizontally inside a brush container during non use instead of allowing the paint to drain into the container.

As such, there exists a need for a device which will allow for containment of and prevention of the evaporation of volatile solvents contained in paint, varnish, and other liquid coatings used for protection and decoration, while not requiring the cleaning of painting utensils each time the container is left unattended. An additional need exists for such a device that would allow overnight or longer term storage of painting utensils while concurrently eliminating the wasted time and higher costs which occur from cleaning of utensils when they are to be left for a long period of time prior to reuse. A further need exists for such a device that is easily attachable to conventionally used paint containers with no modification to the containers being required thus augmenting the ease of use of such containers without modification thereto.

SUMMARY OF THE INVENTION

The present invention relates to a new and improved container lid and a utensil holder which allows for storage of painting utensils used by professionals and non professional painters alike. The device allows for use of the conventional lid for conventionally used commercial paint containers by attachment of a fixed length, telescopic, or collapsible utensil containment cylinder or tube thereon which is fabricated to cooperatively engage and seal with the bung hole on conventional five gallon and one gallon paint containers. An optional adapter lid may be employed for factory provided smaller containers or containers without a bung hole or similar resealable apertures therein.

The lid of larger paint containers normally features one or a plurality of apertures or bung holes therein for dispensing of paint, varnish, or other liquid therethrough. The device disclosed herein features elongated cylinders which are sealed at one end and threaded or otherwise configured to cooperatively engage the threaded or otherwise configured orifice communicating through the lid into the container of paint or other volatile liquid. The elongated cylinder and lid can also be made as a unitary structure in one piece, however, the best mode currently features dismountable elongated cylinders which can vary in dimensions to allow for removable engagement with different sized painting instrument handles therein. Being dismountable and of variable length allows for the use of the containment cylinder on multiple containers and allows the painter to vary the application tool used.

In use, the professional or nonprofessional painter while using a conventional five, ten, or other container as a reservoir for painting, may wish to leave for a short time or until the next painting session. To comply with current and ever more stringent Environmental Protection Agency and other environmental regulations, currently the painter would have to seal the container and wash or otherwise store the painting utensils in a sealed container. Even for short breaks the painting utensils would have to be cleaned or somehow sealed into container or bag to prevent drying and evaporation of vapors. Such constant sealing requirements cause lost time and may in fact cause increased pollution to waterways receiving the paint and varnish washed from the brush and rollers. Further, the time taken to seal, clean, and unseal the containers and utensils may in fact be longer than the break taken by the painter costing employers millions of hours each year when complying with break and lunch requirements of employment codes.

This dilemma in the waste of time and paint is solved by the applicant's device disclosed herein. The painter simply takes the handle of the painting utensil being used and inserts it through the conventional bung hole or similar orifice in the lid and into the communicating interior of the properly configured elongated cylinder which is screwed or otherwise releasably mounted to the lid. Inside the elongated cylinder is a securing device for a removable, yet secure, engagement with the handle such that the handle of the painting device is held in place in the elongated cylinder and exits through the bung hole of the lid. The lid, already being configured for cooperative sealed engagement with the conventional container being used, is simply sealed over the top of the container. This effectively seals the brush or roller inside the same container as the paint in a removably secure position being held by the cooperative removable engagement of the utensil handle with the interior of the elongated cylinder. The painter may leave the site for a short or prolonged period confident that the container is sealed to government requirements and that the utensil will not dry out or become ruined.

This ability to simply mount the utensil through the lid into the elongated cylinder and seal all into the container is of great benefit to the professional and non professional painter. While still meeting stringent requirements of little or no evaporation, little time is lost to storage and/or cleaning of the utensils for the short or long absence from the job at hand.

Further, because the containment cylinder is releasably mounted to the lid, differently dimensioned and elongated containment cylinders may be used to hold differing utensils. Such a modular containment cylinder allows for great versatility in sealing of utensils inside the factory container without the need for modification to the conventional factory container. With such containers being recycled and refilled, keeping the container unaltered is a prime concern.

An object of this invention is to provide a paint utensil mounting device for storage of utensils inside conventional and newly sized paint and volatile liquid containers which may be easily mounted and dismounted to such containers without modification thereto.

Another object of this invention is to provide a stable sealed container for painting utensils in the same container being used to hold the paint.

A further object of this invention is to provide a paint utensil mounting & storage device, configured to removably seal with conventional containers, which is modular and removably mountable and which may be of various sizes and configurations to accommodate various sized and configured utensils.

An additional object of this invention is to provide a sealing device for professional painters, which allows for storage of brushes and rollers in conventional containers in a sealed fashion during breaks from working which requires minimal time to use.

An additional object of this invention is to lessen the labor and wasted paint which occur from cleaning of painting utensils when the painter is to leave the job for a period of time.

Another object of this invention is to provide a utensil mount an sealing device which will collapse for easy shipment and storage when mounted to conventional containers.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
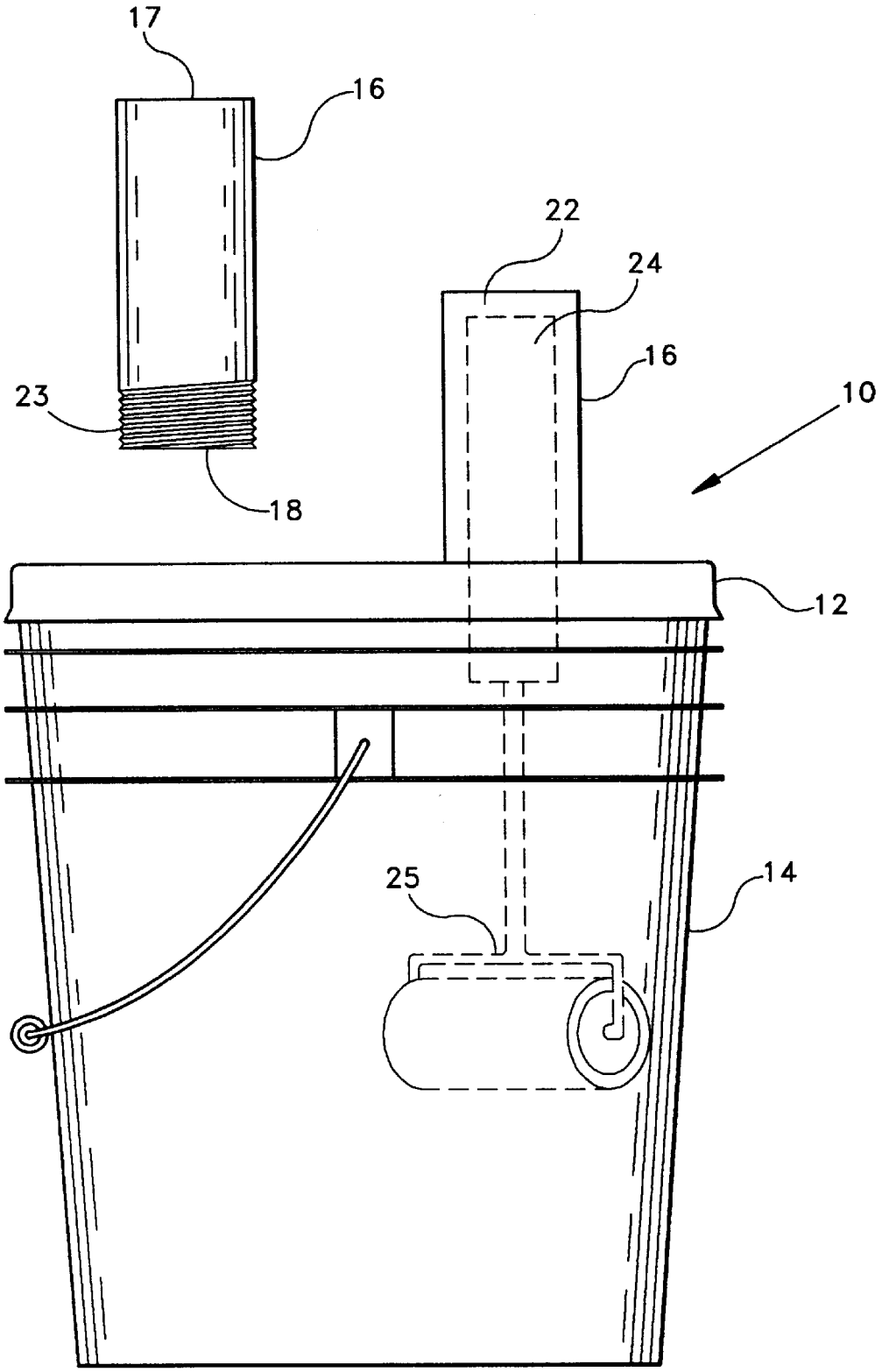
FIG. 1 is a side view of the containment canister sealing device removably mounted upon a conventional container and showing a painting utensil stored therein.

Referring now to the drawing Figures, specifically FIG. 1 depicts a preferred embodiment of the FIG. 1 is a side view of the container sealing device 10 for use in combination with a container of paint or volatile liquid, depicting the lid 12 removably mounted upon a container 13 and showing the removable elongated cylinder 16. The elongated cylinder 16 has a sealed or terminating end formed by end wall 17 and an open end 18 communicating with the interior of the cylinder 16 for insertion of the handle end of a painting utensil into the interior. The cylinder 16 is configured to cooperatively engage an orifice 19 communicating through the lid 12 in a removably sealed relationship. The elongated cylinder 16 may have threads 23 about its outside perimeter at the open or proximal end 18 or otherwise configured to cooperatively engage the orifice 19 communicating through the lid 12 of the container 13 in a sealed and removably mounted relationship.

A frictional mounting adapter 22 in the interior of the cylinder 16 is configured to cooperatively engage the handle 24 of a painting utensil such as a roller 25 or paint brush handle 27*a*. This adapter 22 frictionally engages the exterior of the paintbrush handle 27*a* or roller handle 24, sufficient to hold such a painting utensil handle 24 inside the cylinder 16 when inserted therein. When the lid 12 is mounted upon the container 13 in a sealed relationship, the painting utensil handles 25 and 27*a* is maintained in a removably mounted position at the handle end inside the containment cylinder 16 and out of the paint or varnish in the container 13 keeping the handle end 24 clean and ready to use and keeping the working end moist and undamaged during long or short storage.

The utensil handle 24 may be easily removed by pulling from its engagement with the frictional mounting adaptor 22. Currently the best mode for such engagement of the exterior of the handle 24 features a foam core 26 shaped to engage and mount about the interior circumference of the cylinder 16 and having a mounting aperture 28 therein sized to provide the frictional engagement with the utensil handle end 24. Such a foam has a natural bias toward a center axis of the aperture 28 therein providing the needed frictional engagement with the handle 24. However other conventional manner of holding the exterior of a handle 24 in removable engagement, such as spring loaded fasteners or hook loop fabric could be used and are anticipated.

The containment cylinder 16 can be made in various dimensions to accommodate multiple utensil handles 24 of differing dimensions. A means for attachment of the cylinder to the removable sealing lid of a paint container is achieved by the threads 21 located about the proximal or open end 18 of the cylinder 16 with threads 23 configured to cooperatively engage the threads 21 of a conventional bung hole type orifice 19 communicating through the lid of conventionally used paint containers, the cylinder 16 may be mated to the container lid 12 of the container in which the paint is sold and/or shipped.

Different types of painting dictates the use of different painting utensils of varying length and dimension. Generally however the handle end of the utensil is sized and configured to fit the hand of the user with the working end and the length of the utensil being varied to fit the job required of it. In the modular embodiment of this invention, by varying the dimensions of the cylinder 16, a variety of cylinders 16 may be configured to accommodate a variety of lengths and configurations of utensil handles 24 providing great utility to the user since different painting utensils used at different times may be securely sealed inside the factory paint container by the mounting of the correctly configured elongated containment cylinder 16 in the factory orifice 19 of the factory provided lid 12. No matter what the configuration of the tool of the day, the user may bring along a containment cylinder 16 configured to mount to the orifice 19 in a sealed mount and accommodate the handle 24 in a removable mount and allowing the user easy and quick sealed storage of the utensil during short or prolonged non-use periods.

The lid 12 and cylinder 16 could also be manufactured as a unitary structure by injection molding in the conventional process used to manufacture lids 12. Such unitary lid and cylinder combinations would be fitted with the appropriate mounting adaptor 22, 35, 38, to accommodate all or a portion of the handle 24 of a handled painting utensil inside the cylinder 16 with the working end of the painting utensil concurrently located at the interior of the can side the orifice 19 or bung hole through the lid. The working end of the painting utensil would be held in a position submersed in the paint, partially submersed, or out of the paint depending on the amount of paint therein and the height of the paint container used and long as the lid 12 remains sealed to the container 13 the painting end of the painting utensil will not dry out when held therein. Neither will fumes leak out since the containment cylinder 16 remains in a sealed relationship with the orifice 19 while holding the desired painting utensil. While not having all the adaptability of multiple configured cylinders 16 configured to mount to standard sized bung holes and to accommodate different configured handles 24, the lid cylinder unitary structure could be manufactured and shipped with multiple foam core or other inserts 26 biased toward a center axis of the cylinder 16 sized to operatively accommodate multiple configurations of handles 24 or 27*a*.

Figure 2:
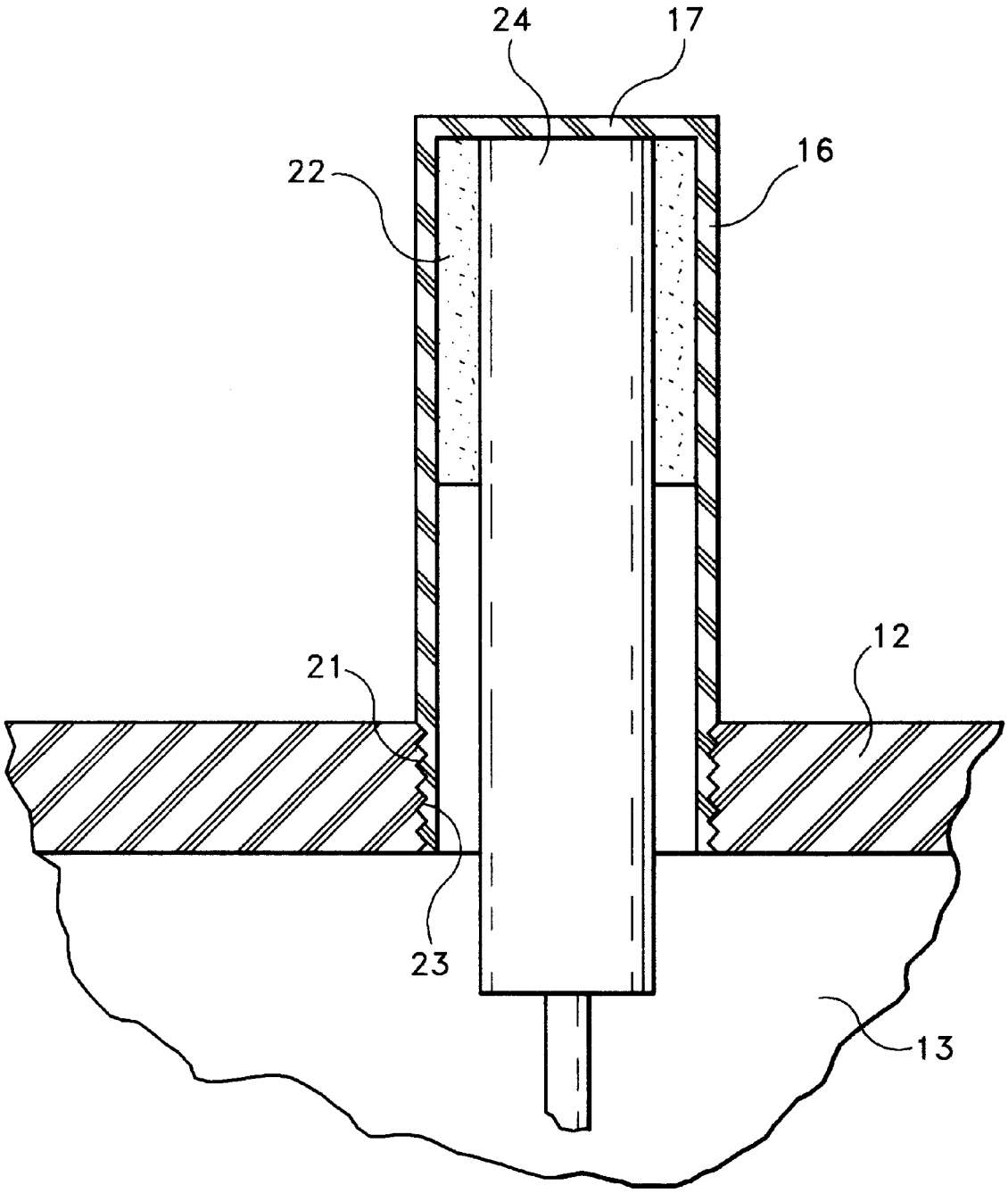
FIG. 2 is a cut away side view of an embodiment of the device featuring a utensil containment cylinder removably engaged with the lid of a container and showing an alternate engagement by frictional slip fit.

FIG. 2 depicts a cut away side view of an embodiment of the device 10 featuring the elongated containment cylinder 16 removably mounted into a lid 12 by cooperating threads 23 engaging the lid threads 21 of the lid bung hole style orifice 19. The lid 12 would mount to the container 13 in the conventional manner in a sealed removable relationship. A slip fit mating of an non-threaded smooth exterior surface of the open or proximal end 18 of the cylinder 16 and the interior of the orifice 19 might also be used as a means for attaching the cylinder 16 to the lid 12 depending on the configuration required. In such a case the cylinder 16 would be dimensioned at the open end 18 to frictionally engage a non threaded lid orifice 19 in a removable yet air tight fit therebetween. The cylinder 16 may be made from metal or molded from conventionally used plastic materials as used for conventional paint containers with lids. The handle 24 is held into a removable engagement inside the cylinder 16 by the frictional mounting adaptor 22 or by other mounting adapters 35 or 38 or variations thereof depending on the handle configuration, all of which will removably hold the handle end of the painting utensil in place in the cylinder 16. Once inserted into the cylinder 16 through the open end 18 which is removably mated to the orifice 19, the utensil handle 24 remains removably mounted therein and the lid 12 may be attached to the container 13 in the conventional fashion to achieve a sealed engagement therewith. The result being that the painting utensil handle is removably mounted in the containment cylinder 16 holding the gripping area of the handle 24 & 27*a* out of the paint, varnish, or other material in the container 13. The working end of the utensil such as the bristles of a conventional paint brush 27 or the paint roller 25 of a conventional roller, is concurrently sealed inside the communicating conventional factory provided container with the paint therein. Consequently paint fumes do not leak to the atmosphere and the working end of the painting utensil is prevented from damage due to drying.

Figure 3:
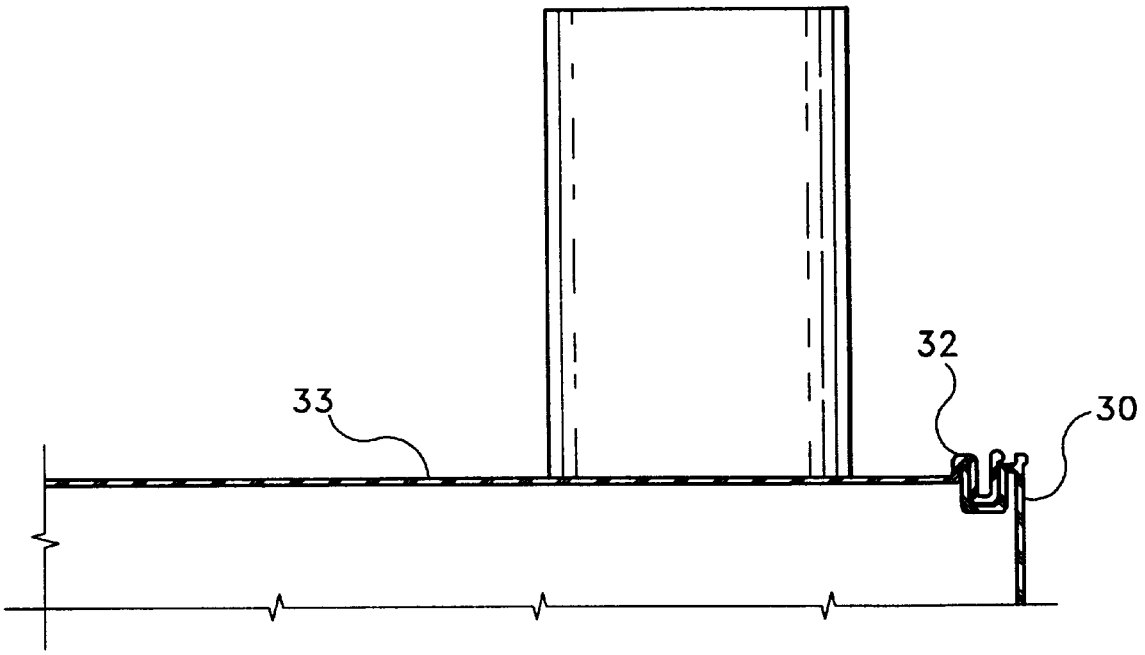
FIG. 3 is side view of an embodiment of the container sealing device for use with conventional one gallon containers.
Figure 4:
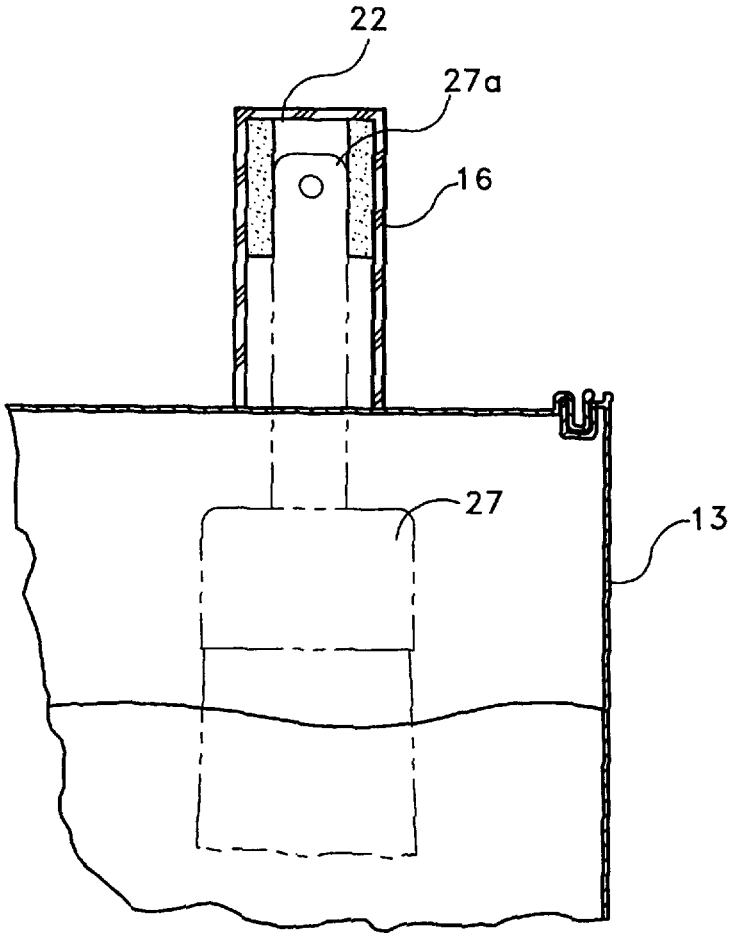
FIG. 4 is a side cut away view of the container sealing device showing a paint brush utensil in phantom line removably mounted in the containment cylinder.

FIG. 3 is side view of another embodiment of the container sealing device for use with conventional one gallon metal paint containers or other containers which lack a factory installed conventional orifice 19. This embodiment would be manufactured to engage the conventional container about a sealing recess 30 using a sealing rib 32 formed on one face of the lid 33. The cylinder may be configured as a unitary construction with the lid 33 or in a more versatile modular version with cooperating cylinder mounting threads 23 about the open end 18 configured to cooperate with threads 21 in the orifice 19. Brushes normally used with such small cans would removably mount inside the cylinder 16 in the aforementioned fashion as depicted in FIG. 4. Of course this embodiment could be of unitary construction or two-piece construction featuring a containment cylinder 16 removably mounted to the lid 33 with the lid 33 configured to mount to the desired container.

FIG. 4 depicts the containment cylinder 16 configured to hold the handle 27*a* of a brush style implement 27 therein supporting the handle above the paint or other liquid in the container when sealed inside the container 13 by the mounting of the lid.

Figure 5:
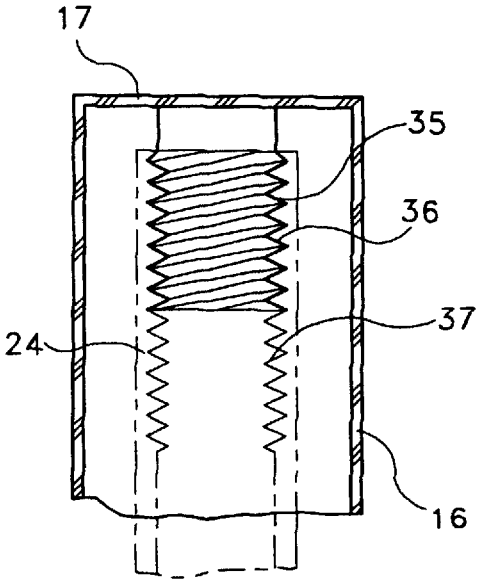
FIG. 5 depicts the sealed end of a containment cylinder showing a protruding screw type mount engaged with a roller handle.

FIG. 5 is a cut away view depicting an end wall 17 attached to the cylinder 16 and forming the sealed end of the containment cylinder 16. A threaded elongated mount 35 is positioned about the center axis of the cylinder 16 at the terminating end wall 17 opposite to the open end 18 and is of a configuration calculated to engage an interior threaded cavity 37 conventionally placed in the handles 24 of painting rollers and similar painting utensils with handles. In use the threaded handle cavity 37 of a conventional painting roller handle is quickly and easily attached to the protruding cooperatively threaded nipple mount 35 having nipple threads 36 dimensioned to cooperate with those of the cavity 37 by insertion through the orifice 19 and into the containment cylinder 16 thus providing one type of means for holding the handle portion of a paint utensil in the cylinder interior. The lid 12 is then mounted to the container 13 encasing both paint and utensil in a sealed container with the handle in a position to stay dry and out of reach of the liquid therein.

Figure 6:
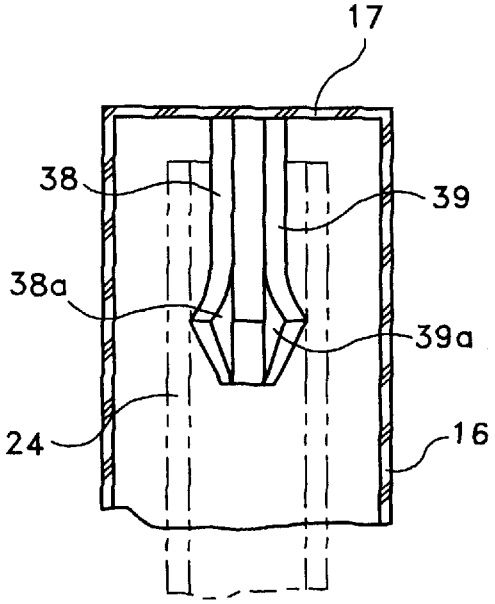
FIG. 6 depicts the sealed end of a containment cylinder showing a protruding biased handle engagement frictionally engaging the interior of a utensil handle.

FIG. 6 depicts an outwardly biased and inwardly collapsible embodiment of a means for holding the handle of a painting utensil featuring a handle mount 38 located substantially at the center axis of the containment cylinder 16 and mounted at the terminating closed end of the containment cylinder 16. The collapsible handle mount 38 has individual flexible reed members 39 having defined gaps 38*a* therebetween forming the mount 38. A shoulder area 39*a* formed upon the collapsible mount 38 is positioned and sized to engage the wall of the treaded or frictionally engage the otherwise surfaced interior handle cavity 37 of a utensil handle 24 to removably hold the handle 24 in position upon the collapsible mount 38 when inserted thereover. Removal of the handle 24 from the collapsible mount 38 requires the user to simply pull the handle 24 and containment cylinder 16 in opposite directions wherein the force thereon applied causes the reed members 39 to compress inwardly into the gaps 38*a* therebetween and toward the center axis of the containment cylinder 16 the resulting reduction in the perimeter of the shoulder 39*a* allowing for concurrent removal of the handle 24 from the collapsible mount 38. This embodiment allows for the easiest and quickest mounting and dismounting of the handle 24 for job sites where constant storage and use cycles occur.

For additional utility the end wall forming the terminating end wall 17 or closed end of the cylinder can also be configured to removably mount to the distal end of the cylinder 16. When a number of the end walls 17 are configured with differing mounts 22,35, or 38, the user can change the mount for the handle 24 to match the configuration desired or required at the time.

Figure 7:
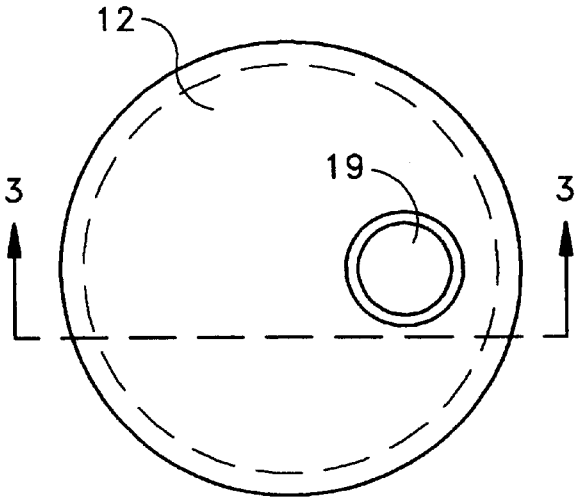
FIG. 7 is a top view of the container sealing device showing a communicating lid orifice therein.

FIG. 7 is a top view of a conventional paint container lid 12 configured to engage and removably mount to a conventional paint container 13. Such lids conventionally feature a threaded or frictionally engageable orifice 19 to allow the user to pour the paint therefrom and have a removable plug therein for sealing the orifice 19. In the event that paint containers in use do not have such an orifice 19 located in the lid 12, a lid having such an orifice 19 could be provided as an option to this invention to allow attachment of the invention to such a container lacking the properly configured lid.

Figure 8:
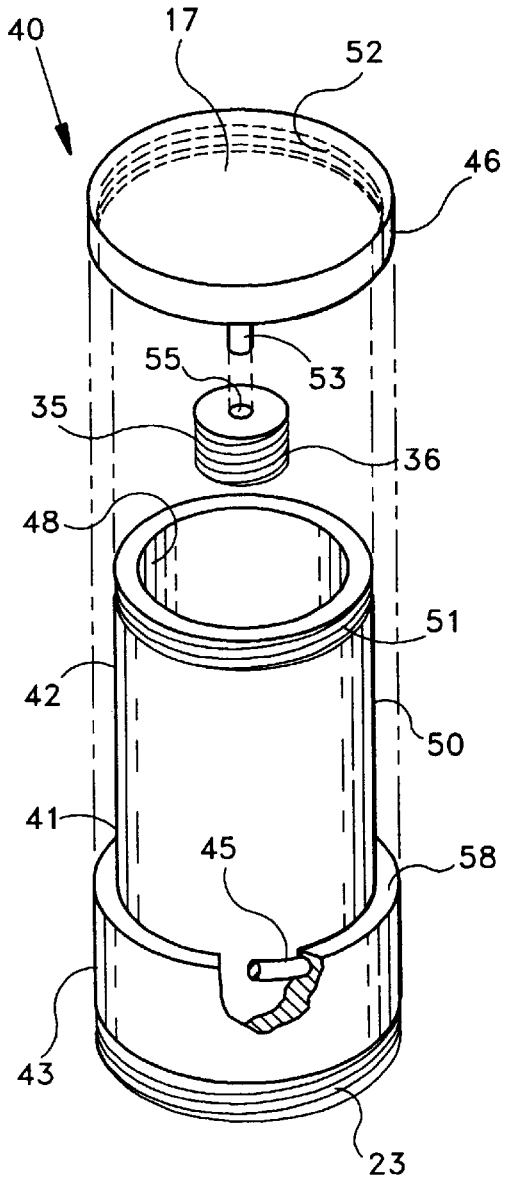
FIG. 8 is a perspective cut away view of a telescopic embodiment of the invention.

FIG. 8 is a perspective cut away view of a telescopic embodiment 40 of my invention. This embodiment has an elongated telescopic cylinder 41 featuring a first portion 42 of the telescopic embodiment of the cylinder 41 which inserts into a base portion 43 of the telescopic cylinders 41 however more than two portions may be used by the addition of one or more smaller diameter additional tubular portions each retractable into the portion below, and each with a sealing means 45, to achieve the desired height above the lid 12 to hold the roller handle 25 or brush handle 27*a* in the desired position. The seal 45 is located on the interior of the base portion 43 which provides a seal between the base portion 43 and the exterior of the first portion 42 and provides the additional function of a frictional engagement with the exterior of the first portion 42. This frictional engagement is sufficient to allow the first portion 42 to remain in a telescoped position when a roller handle 24 or brush handle 27*a* is attached to the cap 46 during use. In this embodiment the telescoping elongated cylinder can also be used as a pour spout when the cap 46 is removed and the elongated cylinder is extended to an elongated position from a retracted position. This embodiment or the collapsible embodiment in FIG. 9 would be suited best for use by manufacturers of paint containers as their ability to collapse or retract relatively flush or below with the top side of the lid 12 when mounted to the container, allows for easy stacking of paint containers for shipping. This embodiment would also attach to the lid in the aforementioned manners using the slip fit or threaded attachement.

If a removable end cap 46 is not desirable than the telescopic elongated cylinder 41 can be constructed with a first portion 42 which has an end cap 46 affixed to the top or end distal from the base portion 43. The end cap 46 may either be permanently affixed or part of the first portion 42 or it may be removably attached to the first portion 42 using frictional engagement between the outside circumference of the end cap 46 and the interior circumference 48 of the first portion 42. Threaded engagement may be accomplished using cap engagement threads 51 about the exterior 50 of the first portion 42 which cooperatively engage with interior end cap threads 52 about a cooperatively dimensioned interior threaded cavity of the end cap.

The removable end cap embodiment is the most versatile embodiment of the invention in that it allows the user to change the type of utensil mounting adapter 22,38,35, which is mounted to the mounting adapter positioned upon the interior side of the end cap 46. An elongated threaded nipple style mount 35 having threads 36 dimensioned to cooperatively engage with the interior threads of the interior cavity 37 of a conventional paint roller handle 24 would allow the mounting of the handle 24 to the end cap 46 by simply lining up the threads upon the interior cavity 37 of the roller handle 24 with the mount threads 36 and twisting the handle 24 to achieve a removable mount thereon. Or, if a frictional mount is desired, and end cap 46 can be configured the collapsible handle mount 38 upon it for insertion of the roller handle thereon using the aforementioned frictional engagement with the roller handle 24. Should the user desire to removably mount a paint brush handle 27*a* to the invention, the user can attach an end cap 46 featuring a frictional mounting adapter 22 for cooperative frictional engagement with the handle end 27*a* of the paint brush 27.

Further utility can also be provided by allowing for the removable attachment of the utensil mounting adapters 22,38,35, to the interior wall of the cap 46 or the end wall 17 if permanently attached. Such a removable attachment can be accomplished using a frictional fit between cooperating frictionally engaging cooperatively configured mounts 53 and 55 where the pin 53 would frictionally or otherwise cooperatively engage the receiving mount 55 or other conventional means of mounting the utensil mounting adapters 22,38,35, to the end cap 46 or interior end wall 17. Such an arrangement allows the user to carry different mounts and attach them for the utensil being used at the time instead of carrying multiple caps 46 or complete cylinders 16 with permanently attached utensil brackets.

Other utensil attachments could be positioned either permanently or removably upon the removable end cap 46, or the interior of the end wall 17 when the end wall is permanently affixed to the cylinder 16, to hold new or different painting utensils and such mounting brackets of differing configurations are anticipated.

Mounting of the telescopic embodiment, 40 of the invention would be the same as the permanent length embodiment. The mounting end of the base portion 43 can be mated to the orifice 19 using mounting threads 23 which are dimensioned to cooperatively engage conventional threads 21 of a conventional paint container orifice 19. Or, in conventional paint containers using a frictional fit about the interior of the orifice 19 for engagement of a sealing plug, a shoulder 58 may be positioned upon the mounting end of the base portion 43 sized and dimensioned to engage the interior circumference of the orifice 19 such that the shoulder 58 frictionally engages the orifice 19 in a sealed relationship when mounted therein.

As can be seen, by using removable the end cap 46 embodiment the user is allowed to vary the type of mounting to fit the circumstance or need of the user at the time and thus allowing great utility to the user in the form of variability of mounting. The user might even carry various end caps 46 with permanently mounted utensil mounting adapters 22,38, 35, removably mounted utensil mounting adapters 22,38,35 for use in differing situations requiring the mounting and storage of differing paint utensils. However, if such variability is not needed or desired, then a permanently affixed utensil mounting adapters 22,38,35 mounted to the interior side of end wall 17 can be used.

Figure 9:
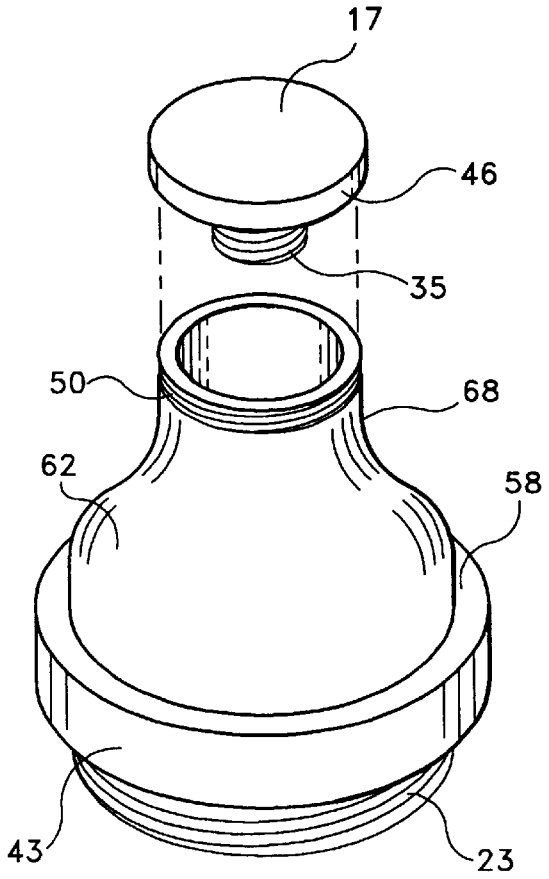
FIG. 9 is a perspective view of a collapsible embodiment of the invention.
Figure 9A:
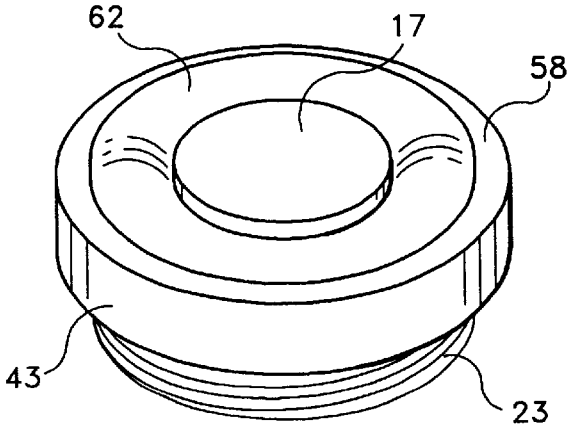

FIG. 9 features an alternate embodiment of a collapsible version of the invention 60 wherein a thin wall collapsible containment cylinder 62 is attached to the base portion 43. In operation the collapsible cylinder 62 made from flexible plastic material has a base area 64 of a diameter wider than an attached neck portion 68. The neck portion 68 collapses into the interior of the base area 64 which will collapse into base 43 when downward force is applied to the neck portion 68 or the attachable cap 46. The neck portion 68 may be repositioned to its elongated state from its collapsed state by a simple pulling upon attached end cap 46. Of course this embodiment would also allow for the varied attachment of differing mounts as the aforementioned telescopic embodiment. The collapsible embodiment 60 would also mount to the orifice 19 in a similar fashion as the telescopic embodiment 40 using threads 23 or slip fit configured open end 18 or a shoulder 58 sized for mounting to orifice 19. This collapsible embodiment might also be made of a unitary construction with the cylinder 62 attached to the base 43.

While all of the fundamental characteristics and features of the paint container attachment with utensil mount invention have been shown and described, it should be understood that various substitutions, modifications, and variations may be made by those skilled in the art without departing from the spirit or scope of the invention. It is intended that all such substitutions, modifications, and variations of elements which perform substantially the same function to achieve substantially the same result are within the scope of this invention. Consequently, all such substitutions, modifications and variations are included within the scope of the invention as defined by the following claims.

What is claimed is:

1. A painting utensil holder for sealed storage of a painting utensil from the atmosphere, for use in combination with a paint container having a removable sealing cover having at least one orifice communicating therethrough, comprising:

a cylinder having connection means at a proximal end;

said cylinder having an open end at said proximal end and an endwall forming a closed distal end;

said connection means engageable in a sealed attachment with at least one orifice communicating through a removable sealing cover of a paint container; and means for holding a handle portion of a painting utensil, located within said cylinder;

whereby said painting utensil, when mounted in said holding means, may be sealed from the atmosphere, when said connection means is attached to said orifice and said sealing cover is attached to said paint container.

2. The painting utensil holder as defined in claim 1 wherein said connection means comprises a first threaded portion about the exterior circumference of said proximal end of said cylinder said first threaded portion configured to cooperatively engage a threaded interior of said orifice.

3. The painting utensil holder as defined in claim 1 wherein said connection means comprises a frictional engagement between the exterior of the proximal end of said cylinder and the interior of said orifice.

4. The painting utensil holder as defined in claim 1 wherein said cylinder is formed of a plurality of cooperatively engaged cylinder sections and said cylinder is telescopically adjustable in length.

5. The painting utensil holder as defined in claim 4 wherein said cylinder also functions as a pour spout for said container, said endwall having said means for holding said handle portion mounted thereon, is removably mountable to the distal end of said cylinder, and, said distal of said cylinder collapses into said proximal end of said cylinder such that said distal end is positionable flush with said outer surface of said cover.

6. The painting utensil holder as defined in claim 1 wherein said cylinder is collapsible whereby said distal of said cylinder will collapse into said proximal end of said cylinder.

7. The painting utensil holder as defined in claim 1 wherein said means for holding the handled portion of a handled painting utensil comprises a frictional mounting adapter configured to frictionally engage the exterior surface of said handled end.

8. The painting utensil holder as defined in claim 1 wherein said means for holding the handled portion of a handled painting utensil comprises a threaded nipple mounted to said end wall on the interior of said cylinder, said threaded nipple configured to cooperative engage threads located on said handle end of said painting utensil.

9. The painting utensil holder as defined in claim 1 wherein said means for holding the handled portion of a handled painting utensil is a handle mount attached to said end wall on the interior of said cylinder substantially at a center axis of said cylinder, said handle mount having outwardly biased inwardly compressible reeds, said reeds outwardly biased in a manner calculated to frictionally engage a cavity located about the center axis of said handled end, said reeds inwardly collapsible to allow attache and removal of said handle end from said handle mount by pulling or pushing said handled end.

10. The painting utensil holder as defined in claim 1 wherein said end wall is removably located upon the distal end of said cylinder whereby said means for holding said handle portion mounted upon said removable endwall may be changed by removal and replacement of said endwall.

11. A painting utensil holder to seal the utensil from the atmosphere for attachment to a paint container:

a removable sealing cover for said paint container, said cover having inner and outer surfaces;

at least one orifice communicating through said sealing cover;

a cylinder having a connection means for sealing engagement with said orifice said connection means located at an open proximal end of said cylinder;

said cylinder having an endwall forming a closed distal end; and, means for holding the handle end of a handled painting utensil located within said cylinder, whereby said painting utensil, when mounted in said means for holding the handle end, may be sealed from the atmosphere, when said connection means is attached to said orifice and said sealing cover is attached to said paint container.

12. The painting utensil holder as defined in claim 11 wherein said connection means comprises a first threaded portion about the exterior circumference of said proximal end of said cylinder said first threaded portion configured to cooperatively engage a threaded interior of said orifice.

13. The painting utensil holder as defined in claim 11 wherein said connection means comprises a frictional engagement between the exterior of the proximal end of said cylinder and the interior of said orifice.

14. The painting utensil holder as defined in claim 11 wherein said cylinder is formed of a plurality of cooperatively engaged cylinder sections and said cylinder is telescopically adjustable in length.

15. The painting utensil holder as defined in claim 11 wherein said cylinder is collapsible whereby said distal of said cylinder will collapse into said proximal end of said cylinder.

16. The painting utensil holder as defined in claim 11 wherein said means for holding the handled portion of a handled painting utensil comprises a frictional mounting adapter configured to frictionally engage the exterior surface of said handled end.

17. The painting utensil holder as defined in claim 11 wherein said means for holding the handled portion of a handled painting utensil comprises a threaded nipple mounted to said end wall on the interior of said cylinder, said threaded nipple configured to cooperative engage threads located on said handle end of said painting utensil.

18. The painting utensil holder as defined in claim 11 wherein said means for holding the handled portion of a handled painting utensil is a handle mount attached to said end wall on the interior of said cylinder substantially at a center axis of said cylinder, said handle mount having outwardly biased inwardly compressible reeds, said reeds outwardly biased in a manner calculated to frictionally engage a cavity located about the center axis of said handled end, said reeds inwardly collapsible to allow attache and removal of said handle end from said handle mount by pulling or pushing said handled end.

19. The painting utensil holder as defined in claim 11 wherein said end wall is removably located upon the distal end of said cylinder whereby said means for holding said handle portion mounted upon said removable endwall may be changed by removal and replacement of said endwall.

20. The painting utensil holder as defined in claim 1 wherein said cylinder also functions as a pour spout for said container and wherein said endwall is removably mountable to the distal end of said cylinder.

* * * * *